US012751541B2

(12) United States Patent
Shi

(10) Patent No.: US 12,751,541 B2
(45) Date of Patent: Oct. 6, 2026

(54) SKIRT BRUSH MECHANISM WITH NOVEL STRUCTURE

(71) Applicant: Zhejiang Yigoli Intelligent Technology Co., Ltd., Hangzhou (CN)

(72) Inventor: Hengzhi Shi, Hangzhou (CN)

(73) Assignee: Zhejiang Yigoli Intelligent Technology Co., Ltd., Hangzhou (CN)

( * ) Notice: Subject to any disclaimer, the term of this patent is extended or adjusted under 35 U.S.C. 154(b) by 453 days.

(21) Appl. No.: 18/501,052

(22) Filed: Nov. 3, 2023

(65) Prior Publication Data

US 2024/0057753 A1 Feb. 22, 2024

(30) Foreign Application Priority Data

Feb. 14, 2023 (CN) ..... 202320282479.7

(51) Int. Cl.
*A46B 13/02* (2006.01)

(52) U.S. Cl.
CPC ..... *A46B 13/02* (2013.01); *A46B 2200/3046* (2013.01)

(58) Field of Classification Search
CPC ..... A46B 13/02; A46B 2200/3046
See application file for complete search history.

(56) References Cited

U.S. PATENT DOCUMENTS 3,708,816 A * 1/1973 Napoli ..... B60S 3/063 15/53.2
3,731,331 A * 5/1973 Haley ..... B60S 3/063 15/53.2
3,777,326 A * 12/1973 Haley ..... B60S 3/063 15/DIG. 2
4,198,722 A * 4/1980 Ennis ..... B60S 3/063 15/DIG. 2
4,299,003 A * 11/1981 Ennis ..... B60S 3/063 15/DIG. 2
4,332,625 A * 6/1982 Ennis ..... B60S 3/063 134/6
4,354,291 A * 10/1982 Ennis ..... B60S 3/063 15/DIG. 2
4,935,982 A * 6/1990 Ennis ..... B60S 3/063 15/DIG. 2
5,367,736 A * 11/1994 Kaady ..... B60S 3/063 15/DIG. 2
5,930,859 A * 8/1999 Ennis ..... B60S 3/063 15/DIG. 2
6,835,140 B2 * 12/2004 Fazio ..... B60S 3/063 464/134

(Continued)

*Primary Examiner* — Nathaniel E Wiehe
*Assistant Examiner* — Theodore C Ribadeneyra
(74) *Attorney, Agent, or Firm* — Hemisphere Law, PLLC

(57) ABSTRACT

The present disclosure relates to a skirt brush mechanism with a novel structure. The skirt brush mechanism includes: a skirt brush, vertically arranged for brushing side surfaces of a vehicle; a swing arm with one end connected to a top of the skirt brush and the other end connected to a fixed connection bracket, and capable of rotating horizontally on the fixed connection bracket; a reduction motor, arranged on the swing arm and in driving connection with the top of the skirt brush to drive the skirt brush to rotate for brushing. The present disclosure can simplify conventional mounting and is not affected by part quality problems of cement floor sites.

5 Claims, 3 Drawing Sheets

(56) References Cited

U.S. PATENT DOCUMENTS

| | | | | |
|---|---|---|---|---|
| 2002/0194690 | A1 | 12/2002 | Vaes et al. | |
| 2006/0218734 | A1* | 10/2006 | Prater | B60S 3/063 15/53.2 |
| 2011/0067727 | A1 | 3/2011 | Chen et al. | |
| 2011/0107529 | A1 | 5/2011 | Hetler | |

* cited by examiner

SKIRT BRUSH MECHANISM WITH NOVEL STRUCTURE

TECHNICAL FIELD

The present disclosure relates to the technical field of car washing machines, and in particular, to a skirt brush mechanism with a novel structure.

DESCRIPTION OF RELATED ART

With the rapid development of China's economy, the automobile industry has developed rapidly, and cars have become the main means of transportation for people's daily travel. China's car ownership is huge, which drives economic development of related fields, such as cleaning of cars. Emergence of current unmanned fully automatic car washing machines can well solve shortcomings of high labor intensity, low efficiency, high labor costs, and high car washing costs existing in conventional manual cleaning with water guns.

As shown in FIG. 3, an existing skirt brush mechanism of a car washing machine is usually fixed by a skirt brush bracket composed of a column and a bottom plate, where the bottom plate is fixed on a cement floor through expansion bolts, and a cylinder drives a swing arm to swing, so as to implement swinging brushing of a skirt brush. Due to frequent action of the cylinder, the expansion bolts are prone to being loosened over time. In addition, the large-sized column bracket consumes a lot of materials and labor, resulting in high cost.

Therefore, there is an urgent need for a skirt brush mechanism with a novel structure, which simplifies a bracket structure, avoids bolt loosening, and reduces costs.

SUMMARY OF THE PRESENT DISCLOSURE

An objective of the present disclosure is to provide a skirt brush mechanism with a novel structure in response to the above problems existing in the prior art.

In order to achieve the above objective, the present disclosure employs the following technical solution: A skirt brush mechanism with a novel structure includes:

- a skirt brush, vertically arranged for brushing side surfaces of a vehicle;
- a swing arm with one end connected to a top of the skirt brush and the other end connected to a fixed connection bracket, and capable of rotating horizontally on the fixed connection bracket;
- a reduction motor, arranged on the swing arm and in driving connection with the top of the skirt brush to drive the skirt brush to rotate for brushing;
- the fixed connection bracket, fixed on an automatic car washing machine and suspended;
- an oblique fixed arm, arranged on one side of the fixed connection bracket and used for mounting a stretching actuator; and
- the stretching actuator with one end rotatably connected to the oblique fixed arm and the other end rotatably connected to the swing arm to drive the swing arm to swing back and forth on the fixed connection bracket.

Working principle and beneficial effects are as follows: 1. Compared with the prior art, the skirt brush of the present disclosure can be fixed on the automatic car washing machine through the fixed connection bracket, and the fixed connection bracket is no longer connected to the cement floor through expansion bolts, so even if the stretching actuator is used frequently, the expansion bolts will not be loosened; a large-sized column bracket is also not required, which can significantly reduce mounting time and cost; and 2. Compared with the prior art, the swing arm of the present disclosure is rotatably connected to the fixed connection bracket, does not need to be mounted through a vertical seat bearing as before, but can be mounted through a rotating shaft, which will not produce an open structure to affect its aesthetics.

Further, a positioning block is arranged on the fixed connection bracket, and the positioning block limits a rotation stroke of the swing arm. In this case, the rotation stroke of the swing arm can be limited by the positioning block, so that the stretching actuator can no longer work at a full stroke every time, which significantly prolongs the service life of the stretching actuator.

Further, the stretching actuator is rotatably connected to a middle segment of the swing arm. The swing arm is conveniently driven to swing.

Further, the fixed connection bracket is rotatably connected to the swing arm through a rotating shaft and a rolling bearing. A conventional vertical seat bearing is replaced, so the structure is more compact and attractive. In addition, the rolling bearing is equivalent to the vertical seat bearing mounted inside, so the structure is relatively hidden, added grease will not be lost due to the impact of high-pressure water thereon, and the appearance is attractive.

Further, the positioning block is provided with a gap, a portion of the swing arm is located inside the gap, and the gap limits the rotation stroke of the swing arm. The stroke is limited by the gap, with a simple structure and low implementation difficulty.

Further, the reduction motor is connected to the rotating shaft through a key slot, and the rotating shaft is connected to the skirt brush through a flange.

Further, the stretching actuator is an air cylinder or an electric cylinder. The air cylinder has the advantages of simple structure and convenient maintenance, is cheaper than the electric cylinder, has high wear resistance, and can operate for a long time. The electric cylinder has fast action, stable power, and high control accuracy, is very convenient to maintain, does not require frequent maintenance, and has a low failure rate. The selection of the air cylinder or the electric cylinder should be considered according to a specific application situation. If high efficiency and fine control are required, the electric cylinder is more suitable. If the requirements are simple and the cost is low, the air cylinder is more suitable.

In the figures, 1. Skirt brush; 2. Swing arm; 3. Reduction motor; 4. Fixed connection bracket; 5. Oblique fixed arm; 6. Stretching actuator; 7. Positioning block; 8. Vertical seat bearing; 9. Skirt brush bracket; 71. Gap.

DETAILED DESCRIPTION OF THE PREFERRED EMBODIMENT

Technical solutions in embodiments of the present disclosure will be clearly and completely described below with reference to the accompanying drawings in the embodiments of the present disclosure. Apparently, the described embodiments are merely some, but not all of the embodiments of the present disclosure. All other embodiments obtained by those of ordinary skill in the art based on the embodiments in the present disclosure fall within the protection scope of the present disclosure.

Those skilled in the art should understand that, in the present disclosure, the orientations or positional relationships indicated by the terms "longitudinal", "lateral", "upper", "lower", "front", "rear", "left", "right", "vertical", "horizontal", "top", "bottom", "inner", "outer", and the like are based on the orientations or positional relationships shown in the accompanying drawings, and are intended to facilitate the description of the present disclosure and simplify the description only, rather than indicating or implying that an apparatus or element referred to must have a particular orientation or be constructed and operated in a particular orientation, and therefore, these terms cannot be interpreted as limiting the present disclosure.

Figure 1:
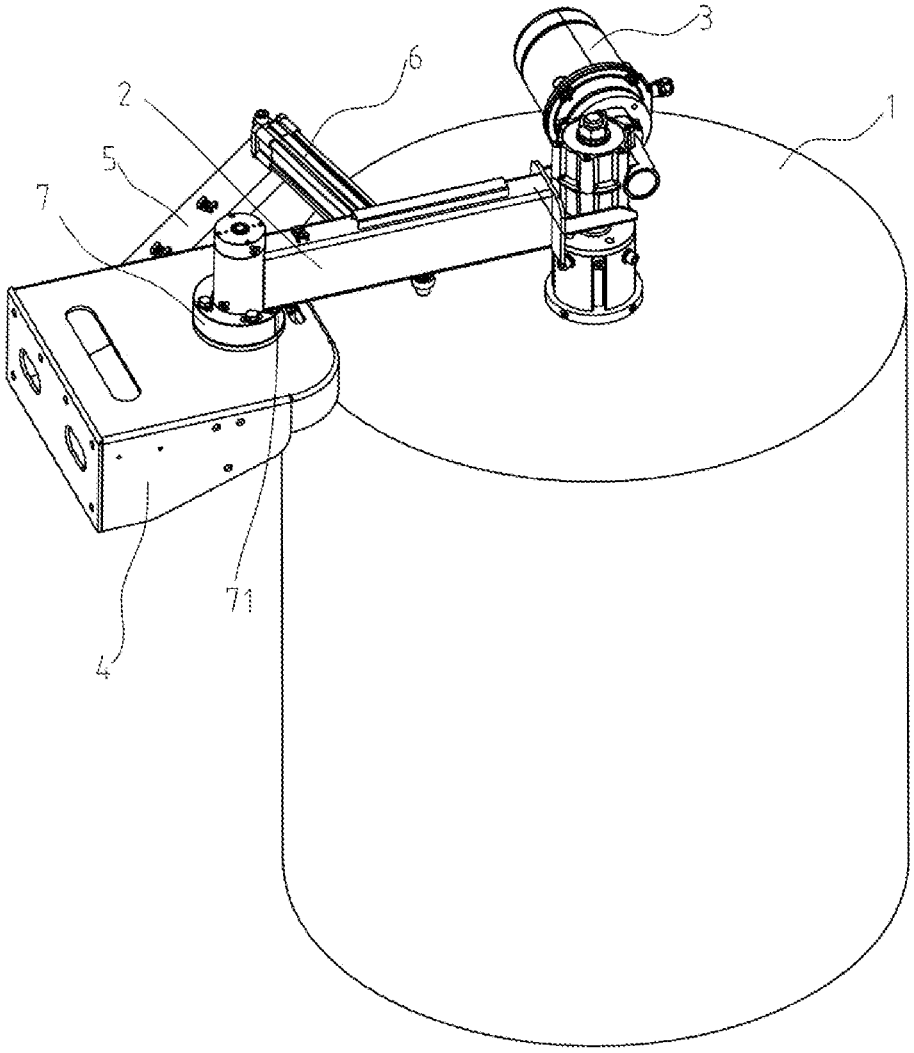
FIG. 1 is a three-dimensional view of the present disclosure.
Figure 2:
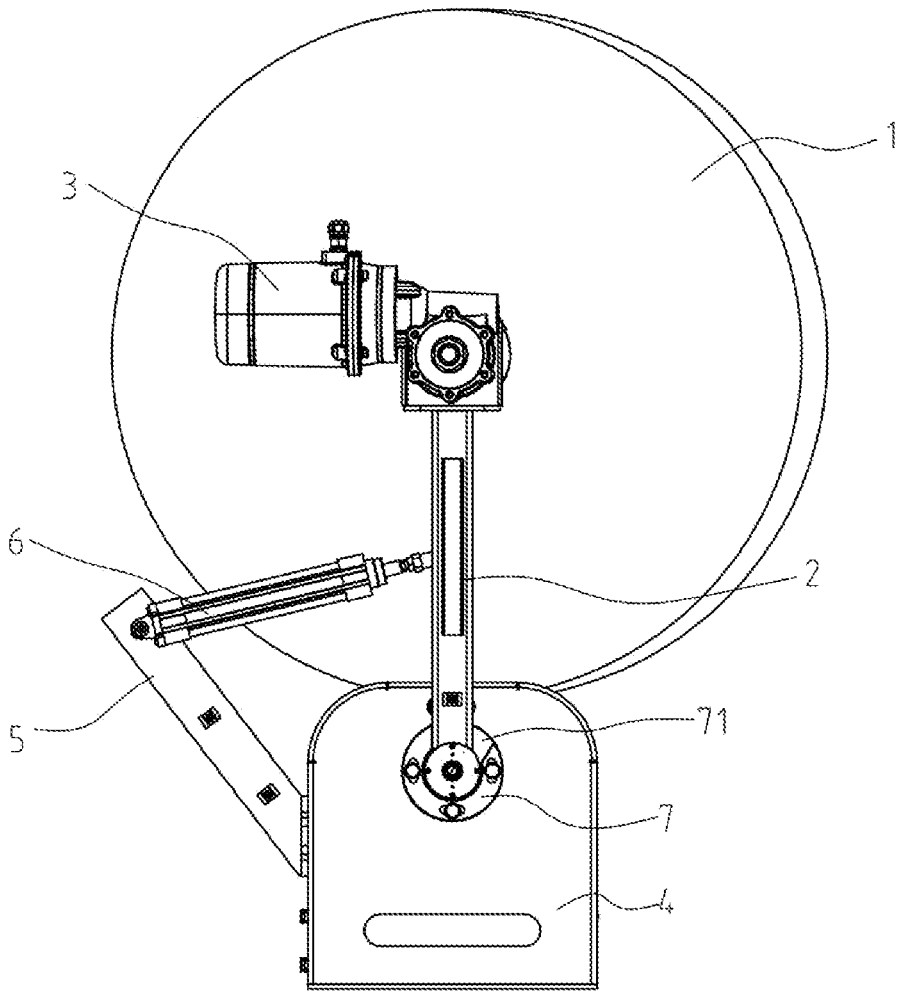
FIG. 2 is a top view of the present disclosure.

As shown in FIGS. 1-2, a skirt brush mechanism with a novel structure includes:

A skirt brush 1, vertically arranged for brushing side surfaces and side skirts of a vehicle;

In this embodiment, the skirt brush 1 is consistent with that in the prior art and will not be repeated here.

Figure 3:
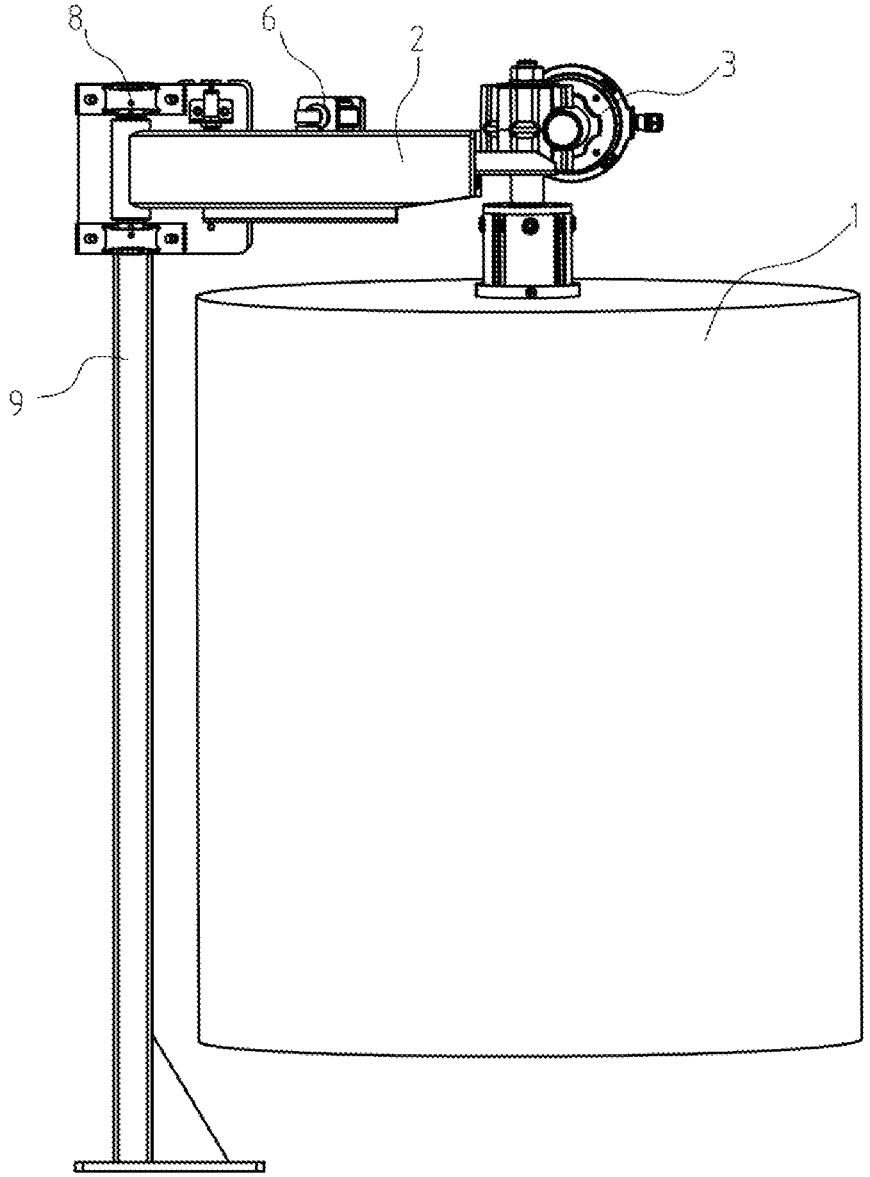
FIG. 3 is a side view of the prior art.

A swing arm 2 with one end connected to a top of the skirt brush 1 and the other end connected to a fixed connection bracket 4, and capable of rotating horizontally on the fixed connection bracket 4;

In this embodiment, the swing arm 2 has been improved in mounting compared to the prior art (as shown in FIG. 3), namely, is not mounted through a vertical seat bearing 8, but the structure of a connecting portion of the swing arm 2 is correspondingly improved.

A reduction motor 3, arranged on the swing arm 2 and in driving connection with the top of the skirt brush 1 to drive the skirt brush 1 to rotate for brushing. The reduction motor is connected to a rotating shaft through a key slot, and the rotating shaft is connected to the skirt brush 1 through a flange.

In this embodiment, the reduction motor 3 is consistent with that in the prior art, and its mounting method is not changed, so it will not be repeated here.

The fixed connection bracket 4, fixed on an automatic car washing machine and suspended;

In this embodiment, the fixed connection bracket 4 replaces a conventional skirt brush bracket 9 (as shown in FIG. 3) and is no longer fixed to a cement floor, but is directly fixed to the automatic car washing machine through threaded fasteners such as anti-loosening bolts. This eliminates the problem of loose connection to the cement floor due to frequent use of a stretching actuator 6, also reduces difficulties in on-site construction, and improves construction speed.

Preferably, a positioning block 7 is arranged on the fixed connection bracket 4, and the positioning block 7 limits a rotation stroke of the swing arm 2. The positioning block 7 is provided with a gap 71, a portion of the swing arm 2 is located inside the gap 71, and the gap 71 limits the rotation stroke of the swing arm 2. In this case, the rotation stroke of the swing arm 2 can be limited by the positioning block 7, so that the stretching actuator 6 can no longer work at a full stroke every time, which significantly prolongs the service life of the stretching actuator 6.

Preferably, the fixed connection bracket 4 is rotatably connected to the swing arm 2 through the rotating shaft and a rolling bearing. A conventional vertical seat bearing 8 is replaced, so the structure is more compact and attractive. In addition, the rolling bearing is equivalent to the vertical seat bearing 8 mounted inside, so the structure is relatively hidden, added grease will not be lost due to the impact of high-pressure water thereon, and the appearance is attractive.

An oblique fixed arm 5, arranged on one side of the fixed connection bracket 4 and used for mounting the stretching actuator 6;

In this embodiment, the oblique fixed arm 5 is substantially not changed in structure, and is mounted on the fixed connection bracket 4 instead of a skirt brush bracket 9, namely, the corresponding connection is changed.

The stretching actuator 6 with one end rotatably connected to the oblique fixed arm 5 and the other end rotatably connected to the swing arm 2 to drive the swing arm 2 to swing back and forth on the fixed connection bracket. The stretching actuator 6 is rotatably connected to a middle segment of the swing arm 2.

In this embodiment, the stretching actuator 6 is an air cylinder or an electric cylinder. The air cylinder has the advantages of simple structure and convenient maintenance, is cheaper than the electric cylinder, has high wear resistance, and can operate for a long time. The electric cylinder has fast action, stable power, and high control accuracy, is very convenient to maintain, does not require frequent maintenance, and has a low failure rate. The selection of the air cylinder or the electric cylinder should be considered according to a specific application situation. If high efficiency and fine control are required, the electric cylinder is more suitable. If the requirements are simple and the cost is low, the air cylinder is more suitable.

The unspecified parts of the present disclosure are the prior art, and therefore, are not detailed in the present disclosure.

It can be understood that the term "a" should be understood as "at least one" or "one or more", that is, in one embodiment, the number of an element may be one, and in another embodiment, the number of the element may be more than one, so the term "a" cannot be understood as a restriction on the number.

Although many terms such as skirt brush 1, swing arm 2, reduction motor 3, fixed connection bracket 4, oblique fixed arm 5, stretching actuator 6, positioning block 7, vertical seat bearing 8, skirt brush bracket 9, and gap 71 are used herein, other terms are not excluded. These terms are used only for describing and explaining the essence of the present disclosure more conveniently. Interpreting the terms as any additional restrictions is contrary to the spirit of the present disclosure.

The present disclosure is not limited to the foregoing best embodiments. Any person can derive other products in various forms under the enlightenment of the present disclosure. However, regardless of any change in shape or structure, all other technical solutions that are the same as or similar to the technical solutions of the present disclosure fall within the protection scope of the present disclosure.

What is claimed is:

1. A skirt brush mechanism, used for an automatic car washing machine, comprising:

a skirt brush, vertically arranged for brushing side surfaces of a vehicle;

a swing arm with one end connected to a top of the skirt brush and the other end connected to a fixed connection bracket, and capable of rotating horizontally on the fixed connection bracket;

a reduction motor, arranged on the swing arm and in driving connection with the top of the skirt brush to drive the skirt brush to rotate for brushing;

the fixed connection bracket, comprising a side wall configured to be fixed on the automatic car washing machine and suspended and a top wall connected to the side wall; wherein a cylindrical positioning block is arranged at the top wall, and a top wall of the cylindrical positioning block defines a mounting opening therein, and a rotating shaft connected to the swing arm is rotatably arranged in the mounting opening of the positioning block, a notch is defined in a peripheral wall of the cylindrical positioning block, a portion of the swing arm is located inside the notch, and the notch limits a rotation stroke of the swing arm;

an oblique fixed arm, arranged on one side of the fixed connection bracket and used for mounting a stretching actuator; and the stretching actuator with one end rotatably connected to the oblique fixed arm and the other end rotatably connected to the swing arm to drive the swing arm to swing back and forth on the fixed connection bracket.

2. The skirt brush mechanism according to claim 1, wherein the stretching actuator is rotatably connected to a middle segment of the swing arm.

3. The skirt brush mechanism according to claim 1, wherein the fixed connection bracket is rotatably connected to the swing arm through a rotating shaft and a rolling bearing.

4. The skirt brush mechanism according to claim 1, wherein the reduction motor is connected to the rotating shaft through a key slot, and the rotating shaft is connected to the skirt brush through a flange.

5. The skirt brush mechanism according to claim 1, wherein the stretching actuator is an air cylinder or an electric cylinder.

* * * * *